US009215961B2

(12) United States Patent
Hsu

(10) Patent No.: US 9,215,961 B2
(45) Date of Patent: Dec. 22, 2015

(54) AUTOMATIC FLOOR CLEANING MACHINE

(71) Applicants: Yejen Appliances (Shenzhen) Limited, Shenzhen (CN); Oceanrich Enterprise Co., Ltd., Shenzhen (CN)

(72) Inventor: Pei-Cheng Hsu, New Taipei (TW)

(73) Assignees: Yejen Appliances (Shenzhen) Limited, Shenzhen (CN); Oceanrich Enterprise Co., Ltd., Shenzhen (CN)

( * ) Notice: Subject to any disclaimer, the term of this patent is extended or adjusted under 35 U.S.C. 154(b) by 377 days.

(21) Appl. No.: 13/948,251

(22) Filed: Jul. 23, 2013

(65) Prior Publication Data

US 2015/0026920 A1 Jan. 29, 2015

(51) Int. Cl.

| | |
|---|---|
| ***A47L 11/00*** | (2006.01) |
| ***A47L 11/40*** | (2006.01) |
| ***A47L 9/02*** | (2006.01) |

(52) U.S. Cl.

CPC ..... *A47L 11/4066* (2013.01); *A47L 9/02* (2013.01); *A47L 11/4038* (2013.01); *A47L 11/4069* (2013.01); *A47L 2201/00* (2013.01)

(58) Field of Classification Search

CPC ..... A47L 9/02; A47L 9/06; A47L 9/0606; A47L 9/0666; A47L 2201/00; A47L 11/4038; A47L 11/4066; A47L 11/4069

USPC ..... 15/49.1, 52, 98, 319, 339, 403

IPC ..... A47L 2201/00

See application file for complete search history.

(56) References Cited

U.S. PATENT DOCUMENTS

| | | | | |
|---|---|---|---|---|
| 6,938,298 | B2 | 9/2005 | Aasen | |
| 7,246,405 | B2 * | 7/2007 | Yan | A47L 5/28 15/340.1 |
| 7,320,149 | B1 * | 1/2008 | Huffman | A47L 11/24 15/319 |
| 2004/0031121 | A1 * | 2/2004 | Martin | A47L 9/02 15/246.2 |

* cited by examiner

*Primary Examiner* — David Redding

(74) *Attorney, Agent, or Firm* — Alan D. Kamrath; Kamrath IP Lawfirm, P.A.

(57) ABSTRACT

An automatic floor cleaning machine includes a base, an upper cover covering the base, a supporting seat mounted on the base, a random-turn driving unit installed on the supporting seat, and a floor cleaning plate installed on a bottom of the base. The automatic floor cleaning machine is randomly operated over a floor by the random-turn driving unit. Dedusting papers are disposed on a bottom surface of the floor cleaning plate and protruded from two sides or two corners of the base. The dedusting papers turn to sweep and kick up dust particles on the floor when the automatic floor cleaning machine is operating. Thereby, the effect of thorough cleaning of the floor can be achieved. The automatic floor cleaning machine may further include a vacuum cleaner for further enhancing the cleaning effect.

13 Claims, 12 Drawing Sheets

AUTOMATIC FLOOR CLEANING MACHINE

BACKGROUND OF THE INVENTION

The present invention relates to a floor cleaning equipment and, more particularly, to a floor cleaning machine which can move automatically to clean up dust particles on floors.

Dust particles can often be found on floors in common residential and office buildings. Sweeping by manpower or vacuum cleaner is usually used for cleaning up the dust particles. However, because manpower has to be allocated, it will increase the work burden of personnel or the quantity of personnel. In order to relieve or eliminate the work burden, U.S. Pat. No. 6,938,298 to Turbjorn Aasen discloses a mobile cleaning robot, in which a drive unit is used for random movement, and a Velcro system installed under a top-hat is attached with a cleaning cloth. Thereby, the mobile cleaning robot can be moved on a floor surface for performing random cleaning. Further, the cleaning cloth is soft, so that a small portion of the cleaning cloth bulges because of compression when it is moved to adjoining surfaces (such as walls), and thereby the adjoining surfaces can be cleaned. Furthermore, the top-hat itself can be formed as a vacuum suction unit for sucking up dust on the floor. However, the mobile cleaning robot has the following problems during operation:

1. Corrugations will be formed on the cleaning cloth attached under the top-hat when cleaning is performed. The corrugated cleaning cloth will not be able to lay flatly on the floor surface, and, therefore, the cleaning effect will be reduced.

2. The cleaning cloth sheet can only wipe off the floor during cleaning, and, therefore, dust particles adhered on the floor are difficult to be cleaned up effectively.

3. The cleaning of adjoining surfaces (such as walls or corners) is dependent on the quantity of the cleaning cloth bulges, and therefore the cleaning coverage of the adjoining surfaces is often uneven.

BRIEF SUMMARY OF THE INVENTION

It is an objective of the present invention to provide an automatic floor cleaning machine for reliably cleaning dust particles on floors. Furthermore, the automatic floor cleaning machine of the present invention can also sweep the dust particles on the floors to kick up the dust particles, and then a vacuum cleaner is used for sucking up the dust particles thoroughly.

To achieve this and other objectives, an automatic floor cleaning machine according to a first embodiment of the present invention includes a base, an upper cover, a supporting seat, a random-turn driving unit, and a floor cleaning plate. The base includes a disc having an opening disposed in the disc. A protruded edge is formed around a circumference of the opening, and a power unit is disposed on the disc. The upper cover is engaged on the base, and an accommodating space is formed between the upper cover and the base. The supporting seat is engaged on the disc of the base and received in the accommodating space between the upper cover and the base. The supporting seat includes a top plate and a circumferential portion extending downwardly from a circumference of the top plate. A motor base is formed on the top plate. The circumferential portion is mounted around the protruded edge of the disc, and a convoluted space is formed by the circumferential portion and the opening of the disc. The random-turn driving unit includes a motor and a drive wheel set. The motor is fixed on the motor base of the supporting seat and electrically connected to the power unit. The motor includes an output shaft protruded from a bottom of the motor. The drive wheel set is disposed inside the convoluted space and includes a lower wheel base and an upper wheel base. The lower wheel base includes a lower seat and a shaft rotatably disposed on the lower seat. A driven gear is disposed on the shaft, and a wheel is disposed at each of two ends of the shaft. A drive gear is meshed with the driven gear and includes a driving hole therein. The upper wheel base includes an upper seat coupled to the lower seat and receiving the drive gear. A shaft hole is formed in the upper seat and in alignment with the driving hole of the drive gear. The output shaft extends through the shaft hole and is engaged in the driving hole of the drive gear. The floor cleaning plate is engaged to a bottom of the base and includes a hole in a center of the floor cleaning plate and in communication with the opening of the disc. Velcro is provided on a bottom of the floor cleaning plate and extends outwardly from two sides of the floor cleaning plate. Dedusting papers are engaged on the Velcro.

Preferably, the disc includes a plurality of engaging holes therein. A plurality of protruded fasteners is formed on the floor cleaning plate and around the hole of the floor cleaning plate. A hook is disposed at an upper end of each protruded fastener, and each protruded fastener extends through one of the engaging holes of the base with the hooks engaging the protruded fasteners with the engaging holes.

An automatic floor cleaning machine according to a second embodiment of the present invention includes a base, an upper cover, a supporting seat, a random-turn driving unit, and a cleaning wool fabric. The base includes a disc having an opening disposed in the disc. A protruded edge is formed around a circumference of the opening, and a power unit is disposed on the disc. The upper cover is engaged on the base, and an accommodating space is formed between the upper cover and the base. The supporting seat is engaged on the disc of the base and received in the accommodating space between the upper cover and the base. The supporting seat includes a top plate and a circumferential portion extending downwardly from a circumference of the top plate. A motor base is disposed on the top plate. The circumferential portion is mounted around the protruded edge of the disc, and a convoluted space is formed by the circumferential portion and the opening of the disc. The random-turn driving unit includes a motor and a drive wheel set. The motor is fixed on the motor base of the supporting seat and electrically connected to the power unit. The motor includes an output shaft protruded from a bottom of the motor. The drive wheel set is disposed inside the convoluted space and includes a lower wheel base and an upper wheel base. The lower wheel base includes a lower seat and a shaft rotatably disposed on the lower seat. A driven gear is disposed on the shaft, and a wheel is disposed at each of two ends of the shaft. A drive gear is disposed on the lower seat and meshed with the driven gear. A driving hole is disposed in the drive gear. The upper wheel base includes an upper seat coupled to the lower seat and receiving the drive gear. A shaft hole is formed in the upper seat and in alignment with the driving hole of the drive gear. The output shaft extends through the shaft hole and is engaged in the driving hole of the drive gear. The cleaning wool fabric is engaged to a bottom of the base and includes an upper opening in an upper end thereof for receiving the base. The cleaning wool fabric further includes a lower opening in a lower end thereof and fluff disposed on an outer periphery of the cleaning wool fabric. The wheels of the drive wheel set are exposed outside from the lower opening.

An automatic floor cleaning machine according to a third embodiment of the present invention includes a base, an upper cover, a supporting seat, a random-turn driving unit, and at least one floor cleaning plate. The base includes a disc having an opening disposed in the disc. A protruded edge is formed around a circumference of the opening, and a power unit is disposed on the disc. At least one accommodating chamber is disposed in a bottom of the disc, and a through-hole is disposed in the accommodating chamber of the disc. The upper cover is engaged on the base, and an accommodating space is formed between the upper cover and the base. The supporting seat is engaged on the disc of the base and received in the accommodating space between the upper cover and the base. The supporting seat includes a top plate and a circumferential portion extending downwardly from a circumference of the top plate. A motor base is disposed on the top plate. The circumferential portion is mounted around the protruded edge of the disc, and a convoluted space is formed by the circumferential portion and the opening of the disc. The random-turn driving unit includes a motor and a drive wheel set. The motor is fixed on the motor base of the supporting seat and electrically connected to the power unit. The motor includes an output shaft protruded from a bottom of the motor. The drive wheel set is disposed inside the convoluted space and includes a lower wheel base and an upper wheel base. The lower wheel base includes a lower seat and a shaft rotatably disposed on the lower seat. A driven gear is disposed on the shaft, and a wheel is disposed at each of two ends of the shaft. A drive gear is disposed on the lower seat and meshed with the driven gear. A driving hole is disposed in the drive gear. The upper wheel base includes an upper seat coupled to the lower seat and receiving the drive gear. A shaft hole is formed in the upper seat and in alignment with the driving hole of the drive gear. The output shaft extends through the shaft hole and is engaged in the driving hole of the drive gear. The at least one floor cleaning plate is received in the accommodating chamber of the disc of the base and includes a protruded column on a top surface thereof. The protruded column extends through the through-hole of the disc to engage the floor cleaning plate on the bottom of the disc. Velcro is provided on a bottom of the floor cleaning plate for engaging at least one dedusting paper.

Preferably, the automatic floor cleaning machine further includes a vacuum cleaner provided with a dust sucking mouth in a bottom thereof and two fastening lugs disposed on an outer circumference thereof. The disc includes an accommodation opening spaced from the accommodating chamber and in communication with the opening of the disc. The disc further includes two fastening holes. The vacuum cleaner is installed in the accommodation opening, and the fastening lugs are fastened in the fastening holes of the disc to secure the vacuum cleaner in the base.

The present invention will become clearer in light of the following detailed description of illustrative embodiments of this invention described in connection with the drawings.

DETAILED DESCRIPTION OF THE INVENTION

Figure 1:
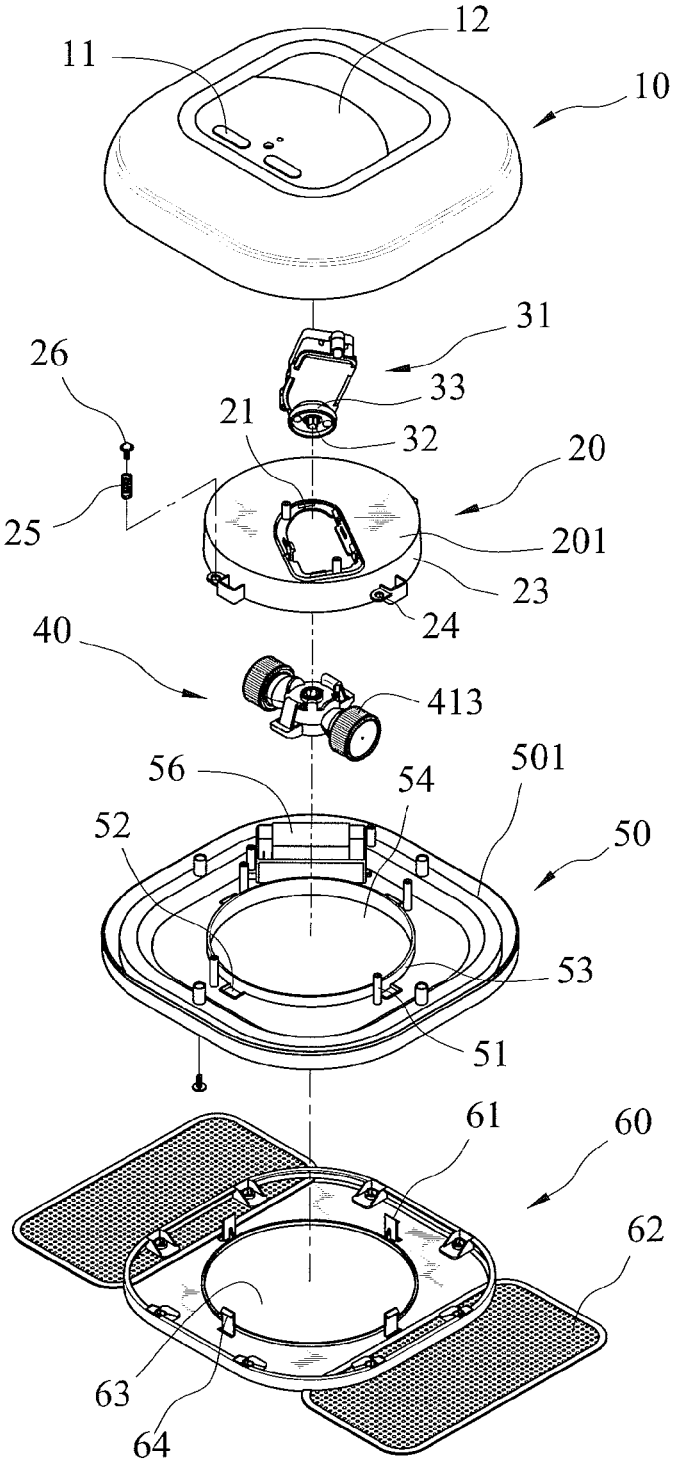
FIG. 1 is an exploded, perspective view of an automatic floor cleaning machine according to a first embodiment of the present invention.
Figure 2:
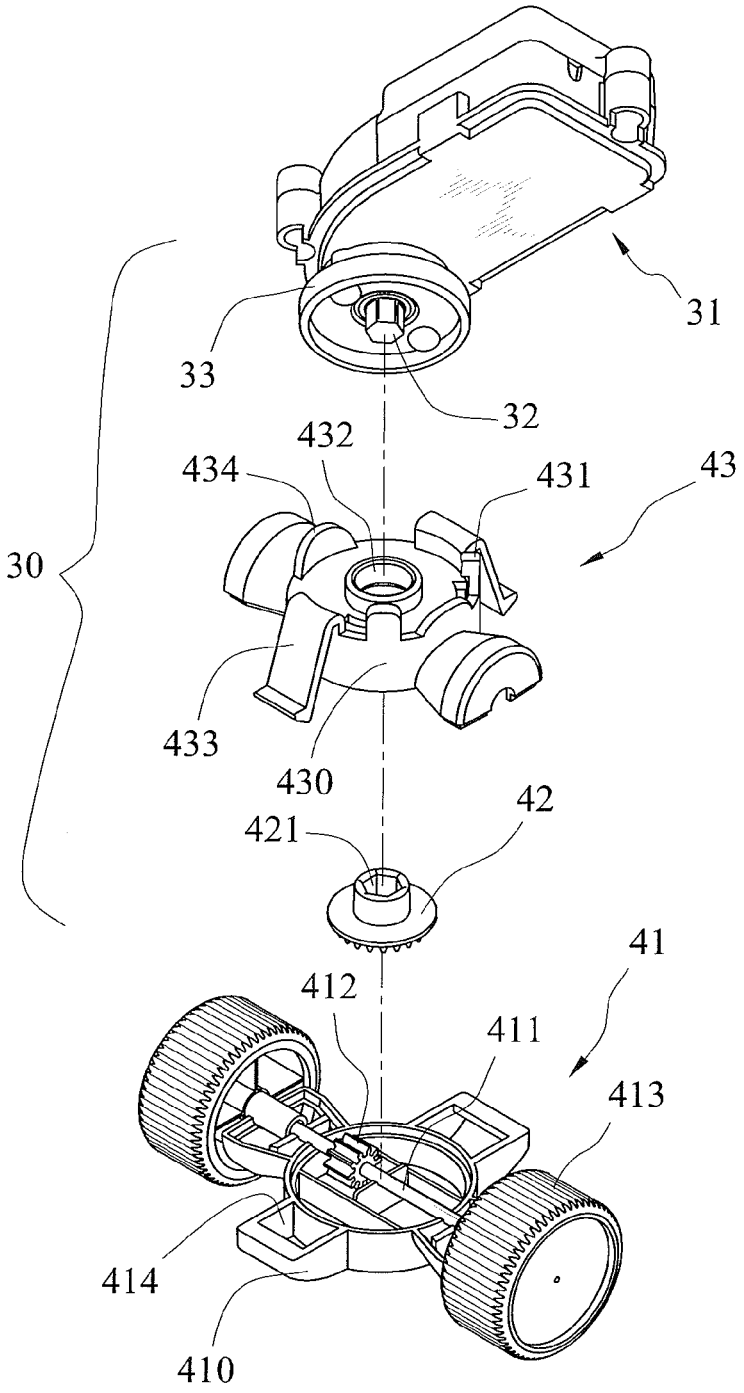
FIG. 2 is an exploded, perspective view of a random-turn driving unit of the floor cleaning machine of FIG. 1.
Figure 3:
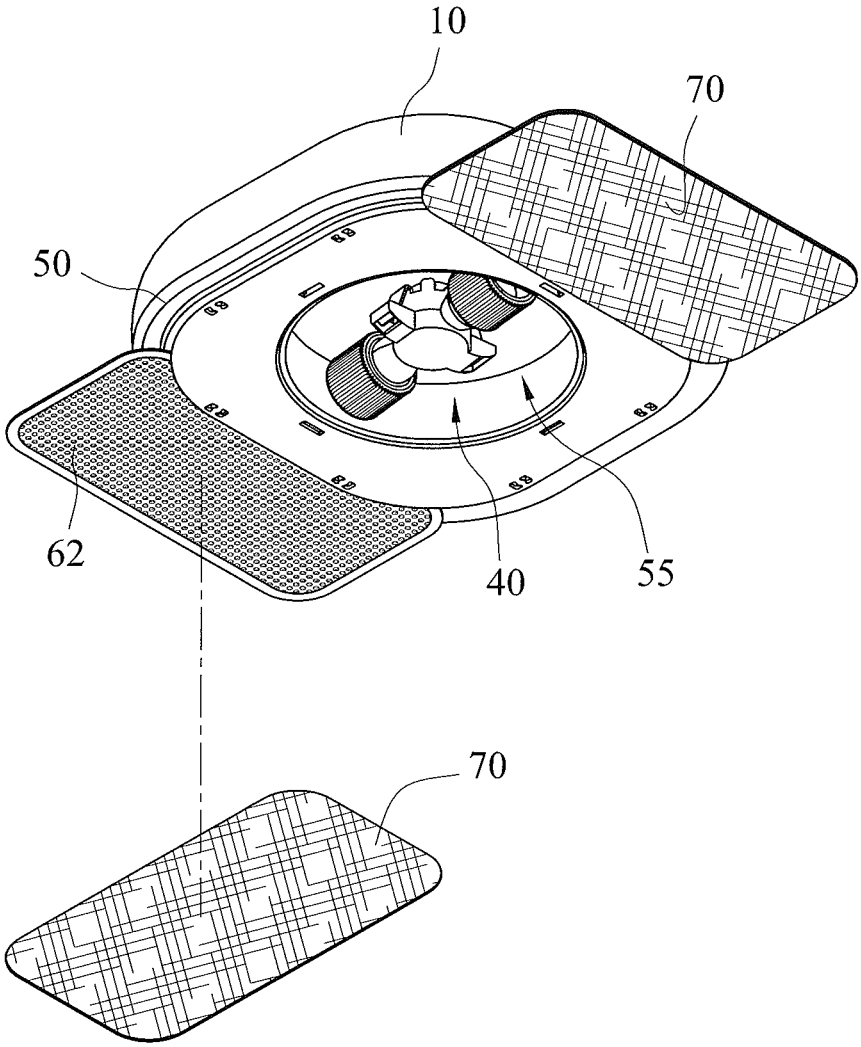
FIG. 3 shows an exploded, perspective view of a dedusting paper adhered on a bottom surface of a floor cleaning plate of the floor cleaning machine of FIG. 1.

An automatic floor cleaning machine according to a first embodiment of the present invention is shown in FIGS. 1 through 5 of the drawings and includes a base 50, an upper cover 10, a supporting seat 20, a random-turn driving unit 30, and a floor cleaning plate 60. The base 50 includes a disc 501. A circular opening 54 is disposed in a center of the disc 501, and a protruded edge 53 is formed around a circumference of the opening 54. The disc 501 includes a plurality of coupling columns 51 and engaging holes 52 adjacent to coupling columns 51. A power unit 56 is disposed on the disc 501.

The upper cover 10 is engaged on the base 50, such that an accommodating space (not labeled) is formed between the upper cover 10 and the base 50 for installing the supporting seat 20 and the random-turn driving unit 30. A handle 12 is disposed on a top of the upper cover 10 for convenience of carrying. A switch 11 is also disposed on the top of the upper cover 10 for controlling the startup of the automatic floor cleaning machine.

The supporting seat 20 is shaped as a canopy and includes a top plate 201 and a circumferential portion 23 extending downwardly from a circumference of the top plate 201. A motor base 21 is disposed on the top plate 201 for installing a motor 31. The supporting seat 20 is engaged on the disc 501 of the base 50, and the circumferential portion 23 is mounted around the protruded edge 53. Thereby, a convoluted space 55 is formed by the circumferential portion 23 and the opening 54 of the disc 501. In this embodiment, a plurality of lugs, each of the lugs with a connecting hole 24, extends outwardly from an outer surface of the circumferential portion 23. Each of the coupling columns 51 is mounted around by a spring 25 and secured by a screw 26 after extending through a corresponding connecting hole 24. Thus, the supporting seat 20 can be elastically fixed on the base 50.

The random-turn driving unit 30 includes the motor 31 and a drive wheel set 40. A conventional deceleration unit (not shown in the drawings) is disposed inside the motor 31. The motor 31 is fixed on the motor base 21 and electrically connected to the switch 11 and the power unit 56. An annular flange 33 is disposed on a bottom of the motor 31, and a hexagon output shaft 32 is protruded from the bottom of the motor 31 and located in the annular flange 33 for connecting with the drive wheel set 40.

The drive wheel set 40 includes a lower wheel base 41 and an upper wheel base 43. The lower wheel base 41 includes a lower seat 410 and a shaft 411 rotatably disposed on the lower seat 410. A driven gear 412 is disposed on the shaft 411, and a wheel 413 is disposed at each of two ends of the shaft 411.

A drive gear 42 is disposed on the lower seat 410 and meshed with the driven gear 412. A hexagonal driving hole 421, for coupling with the output shaft 32, is disposed in a center of the drive gear 42. Two opposite coupling holes 414 are disposed in the lower seat 410 and located at two sides of the shaft 411. The upper wheel base 43 includes an upper seat 430 coupled to the lower seat 410 and receiving the drive gear 42. A spring buckle 433 is disposed on each of two sides of the upper seat 430. The shaft 411, the driven gear 412 and the drive gear 42 are covered by the upper wheel base 43 with the two spring buckles 433 engaged in the two coupling holes 414 correspondingly when the upper seat 430 is engaged on the lower seat 410. A shaft hole 432 is formed in a center of the upper seat 430 and in alignment with the driving hole 421. The output shaft 32 extends through the shaft hole 432 and is engaged in the driving hole 421 of the drive gear 42, so that the output shaft 32 can drive the driven gear 412 to turn through the drive gear 42. A plurality of fasteners 431 and stopping pieces 434 are formed on a top edge of the upper seat 430. After the motor 31 is installed on the motor base 21, the stopping pieces 434 are pressed against the annular flange 33, and the fasteners 431 are slightly stretched in an elastic fashion for fastening the annular flange 33. Thereby, the motor 31 and the drive wheel set 40 can be engaged together securely. The output shaft 32 is engaged in the driving hole 421 for transferring dynamic force, and the drive wheel set 40 is disposed inside the convoluted space 55. Thus, the drive wheel set 40 can be turned freely inside the convoluted space 55.

The floor cleaning plate 60 is engaged to a bottom of the base 50 and has a shape roughly the same as that of the disc 501. A hole 63 is disposed in a center of the floor cleaning plate 60 and in communication with the opening 54 of the disc 501. A plurality of protruded fasteners 61 is formed on an upper surface of the floor cleaning plate 60 around the hole 63, and a hook 64 is disposed at an upper end of each protruded fastener 61. Each protruded fastener 61 of the floor cleaning plate 60 extends through one of the engaging holes 52 of the base 50, and the hook 64 is used for engaging the protruded fastener 61 with the engaging holes 52. After the protruded fasteners 61 with slight elasticity are pressed and detached from the engaging holes 52, the floor cleaning plate 60 can be taken off. Two rectangular Velcro (magic tapes) 62 are provided on a bottom of the floor cleaning plate 60 and extended outwardly from two sides of the floor cleaning plate 60 for adhering dedusting papers 70. When the floor cleaning machine of the present invention is placed toward a floor, the floor cleaning plate 60 will stay on the floor because of gravity drawdown, and the dedusting papers 70 engaged on the bottom of the floor cleaning plate 60 will also stay on the floor.

Figure 4:
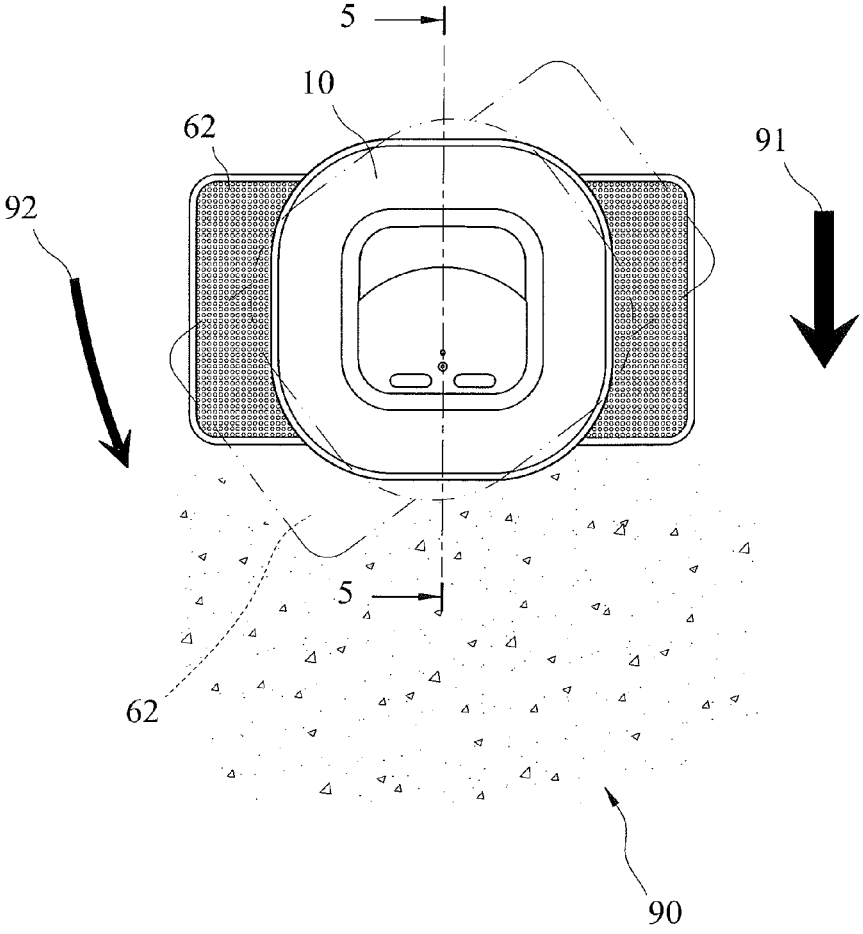
FIG. 4 is a schematic view of the floor cleaning machine of FIG. 1 being embodied.
Figure 5:
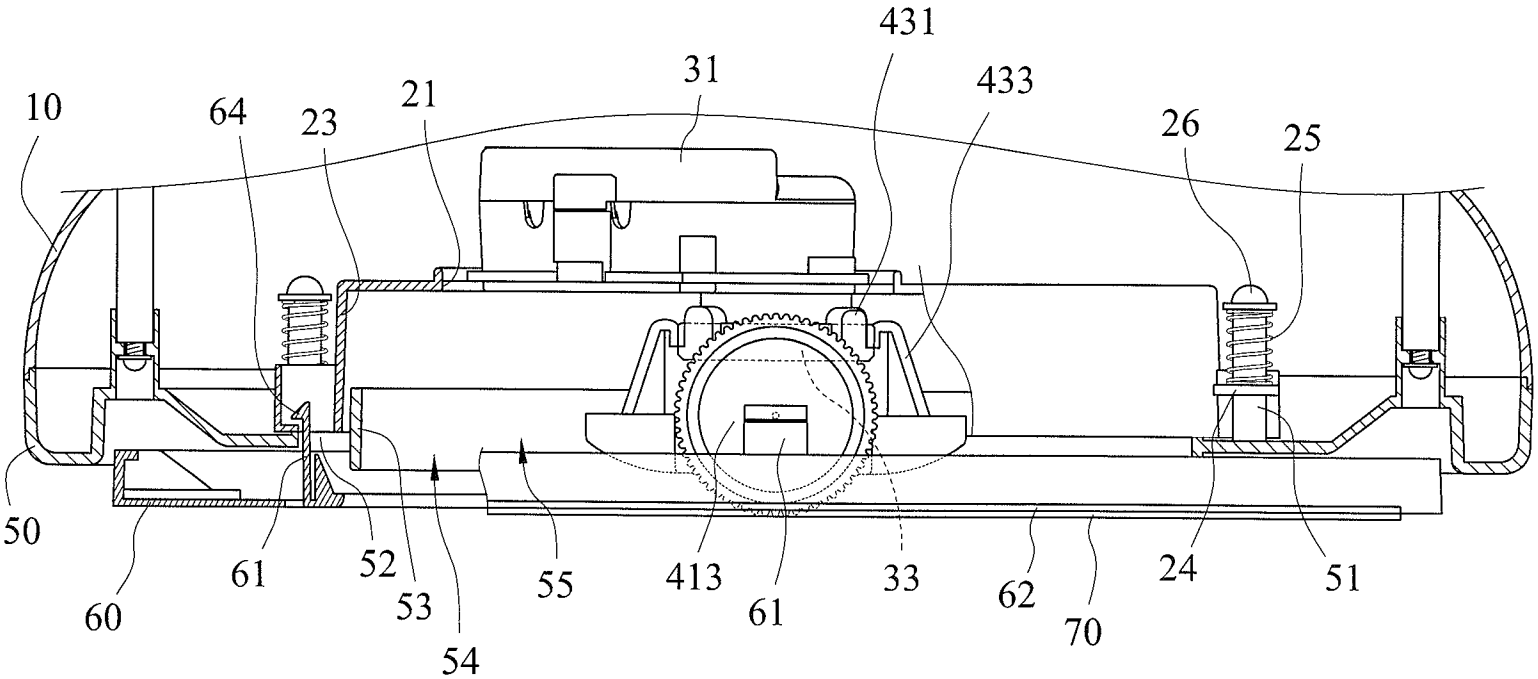
FIG. 5 is a cross-sectional view taken along line 5-5 in FIG. 4.

When the floor cleaning machine of the present invention is embodied for cleaning, the automatic floor cleaning machine is placed on a floor 90 (indicated by the arrows 91 in FIG. 4). Then, the switch 11 is turned on (the switch 11 can be set for 15 or 30 minutes, the automatic floor cleaning machine will stop operating when the preset time is up) to cause the random-turn driving unit 30 to operate on the floor 90. When the random-turn driving unit 30 is under operation, the drive wheel set 40 produces reaction torque to cause the automatic floor cleaning machine to turn in a direction opposite to that of the drive gear 42 and to move on the floor 90 randomly (indicated by the arrows 92 in FIG. 4). With the dedusting papers 70 stayed closely on the floor 90 and the random movement of the automatic floor cleaning machine, the dedusting paper 70 protruded from the two sides of the floor cleaning plate 60 can be used for sweeping and cleaning up the dust particles on the floor 90.

Figure 6:
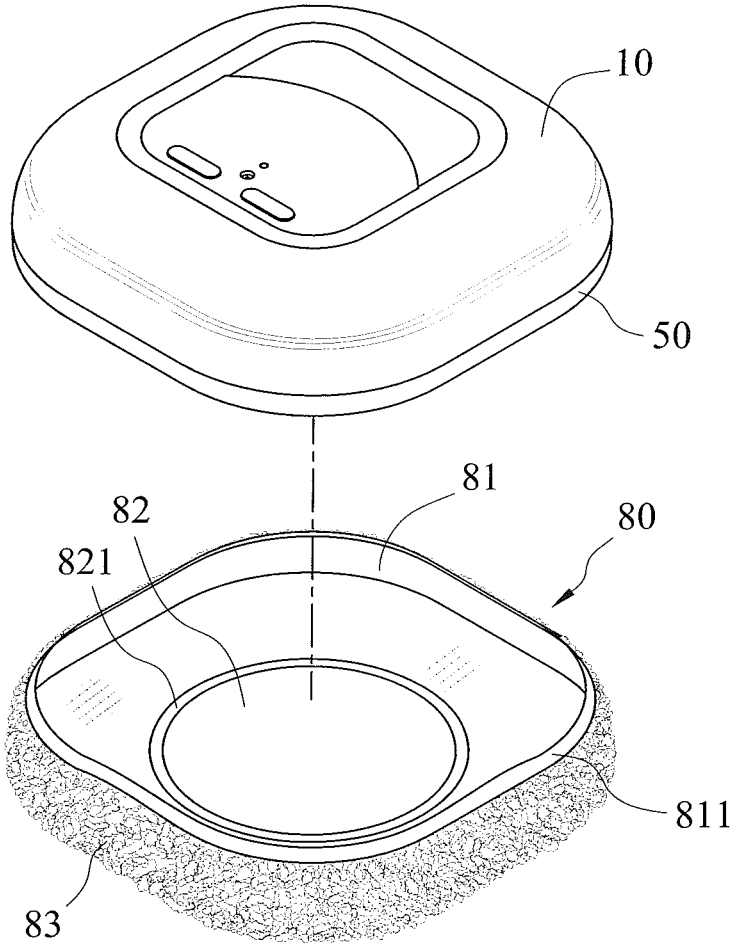
FIG. 6 is an exploded, perspective view of an automatic floor cleaning machine according to a second embodiment of the present invention.
Figure 7:
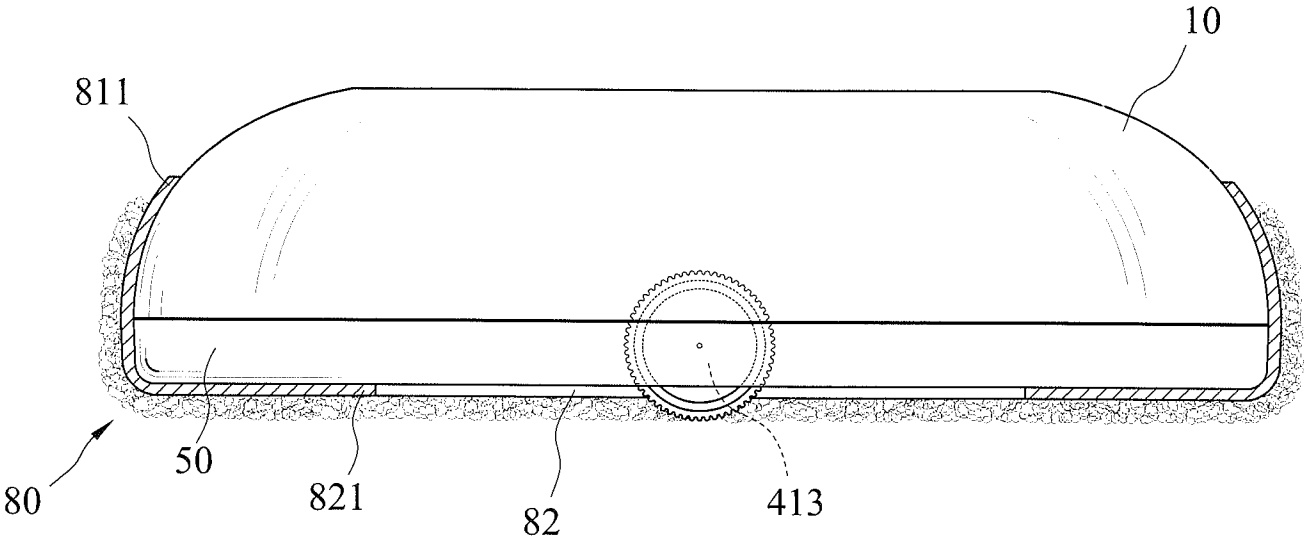
FIG. 7 is a schematic, cross-sectional view of the automatic floor cleaning machine of FIG. 6.
Figure 8:
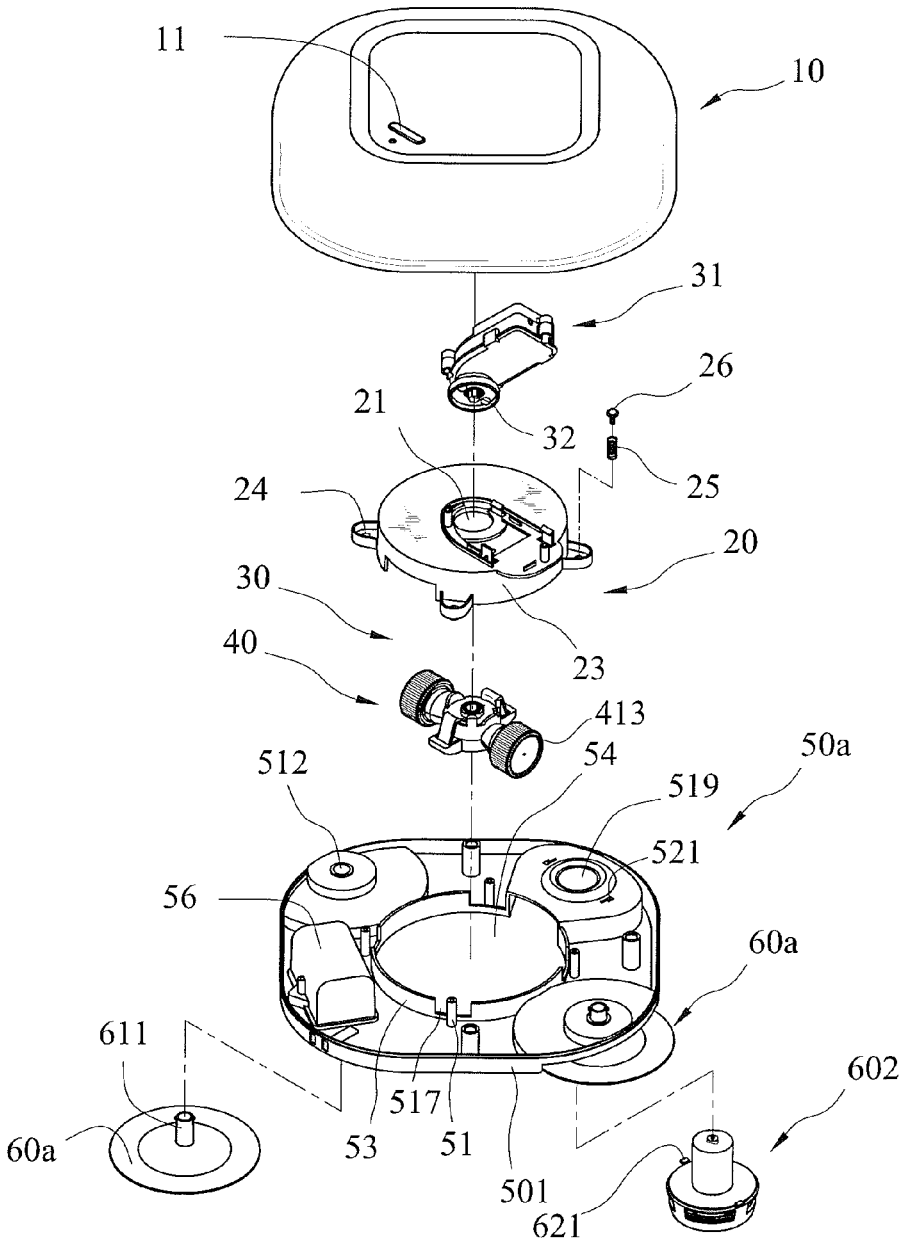
FIG. 8 is an exploded, perspective view of an automatic floor cleaning machine according to a third embodiment of the present invention.
Figure 9:
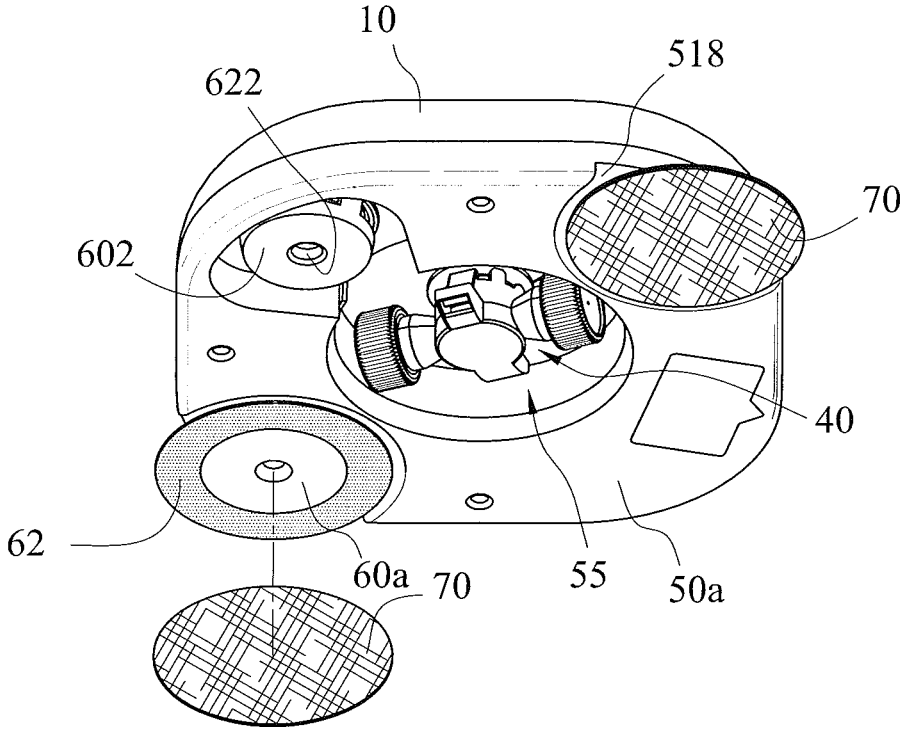
FIG. 9 is a perspective view of the floor cleaning machine of FIG. 8, with a dedusting paper detached from a floor cleaning plate of the floor cleaning machine.

FIGS. 6 and 7 show an automatic floor cleaning machine according to a second embodiment of the present invention and including a base 50, an upper cover 10, a supporting seat, a random-turn driving unit, and a cleaning wool fabric (flannel) 80. The base 50, the upper cover 10, the supporting seat and random-turn driving unit have the same afore-mentioned structures. The cleaning wool fabric 80 is used for replacing the floor cleaning plate 60 in the first embodiment. An upper opening 81 is disposed in an upper end of the cleaning wool fabric 80 for the base 50 to be sleeved and engaged inside. A lower opening 82 is disposed in a lower end of the cleaning wool fabric 80 in order that the wheels 413 of the drive wheel set 40 can be exposed outside from the lower opening 82. Fluff 83 is disposed on an outer periphery of the cleaning wool fabric 80. When the automatic floor cleaning machine is embodied for cleaning, with the cleaning wool fabric 80 stayed closely on the floor and the random movement of the floor cleaning machine, the fluff 83 of the cleaning wool fabric 80 can be used for sweeping and cleaning up the dust particles on the floor. In this embodiment, an inner wall of the upper opening 81 and an upper wall of the cleaning wool fabric 80 are sewed with elastic belts 811 and 821 respectively, so that the cleaning wool fabric 80 can be sleeved around the base 50 securely.

FIGS. 8 through 12 show an automatic floor cleaning machine according to a third embodiment of the present invention. The floor cleaning machine includes a base 50*a*, an upper cover 10, a supporting seat 20, a random-turn driving unit 30, and two floor cleaning plates 60*a*. The base 50*a* includes a disc 501 with a circular opening 54 disposed in a center thereof. A protruded edge 53 is formed around the circumference of the opening 54, and a plurality of indentations 517 is disposed in the protruded edge 53. A plurality of the coupling columns 51 and a power unit 56 are disposed on the disc 501. In this embodiment, a plurality of lugs, each of the lugs with a connecting hole 24, extends outwardly from an outer surface of the circumferential portion 23 of the supporting seat 20. Each coupling column 51 extends through a corresponding connecting hole 24 with the lugs received in the indentations 517 respectively. Then, each coupling column 51 is mounted around by a spring 25 and secured by a screw 26. Thus, the supporting seat 20 can be elastically fixed on the base 50*a*.

Furthermore, an accommodating chamber 518 and a through-hole 512 in communication with the accommodating chamber 518 are disposed in each of two opposite corners of a bottom of the disc 501. Each of the accommodating chambers 518 is provided for installing one of the floor cleaning plates 60*a*. Each floor cleaning plate 60*a* is shaped as a disc and includes a protruded column 611 disposed on a top surface thereof. An elastic fastening lug 612 is disposed at a top end of the protruded column 611. An annular Velcro (magic tape) 62 is disposed on a bottom surface of each floor cleaning plate 60*a* for adhering a dedusting paper 70. The protruded column 611 of each floor cleaning plate 60*a* is inserted into an associated through-hole 512 (FIG. 11), and the fastening lug 612 is used for preventing the protruded column 611 from detaching from the through-hole 512. Further, the floor cleaning plates 60*a* are protruded outside the base 50*a*.

Furthermore, an accommodation opening 519 and two fastening holes 521 in two sides of the accommodation opening 519 are disposed in the disc 501. The accommodation opening 519 is spaced from the accommodating chambers 518 and in communication with the opening 54. The floor cleaning machine of this embodiment further includes a vacuum cleaner 602 with a conventional motor, blades, dust collecting chamber and filter screen disposed therein (not shown). A dust sucking mouth 622 is disposed in a bottom of the vacuum cleaner 602, and two fastening lugs 621 are disposed on an outer circumference of the vacuum cleaner 602. The vacuum cleaner 602 is installed inside the accommodation opening 519 with the fastening lugs 621 fastened in the fastening holes 521 of the disc 501 to secure the vacuum cleaner 602 in the base 50*a*.

Figure 10:
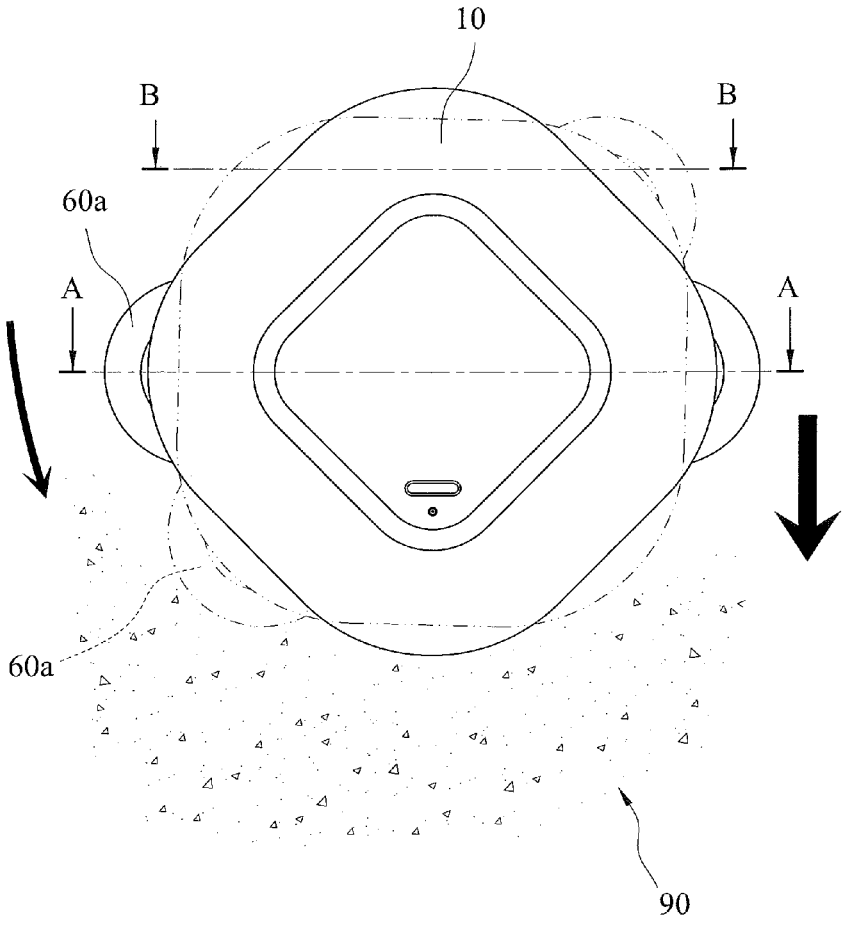
FIG. 10 is a schematic view of the floor cleaning machine of FIG. 8 being embodied.
Figure 11:
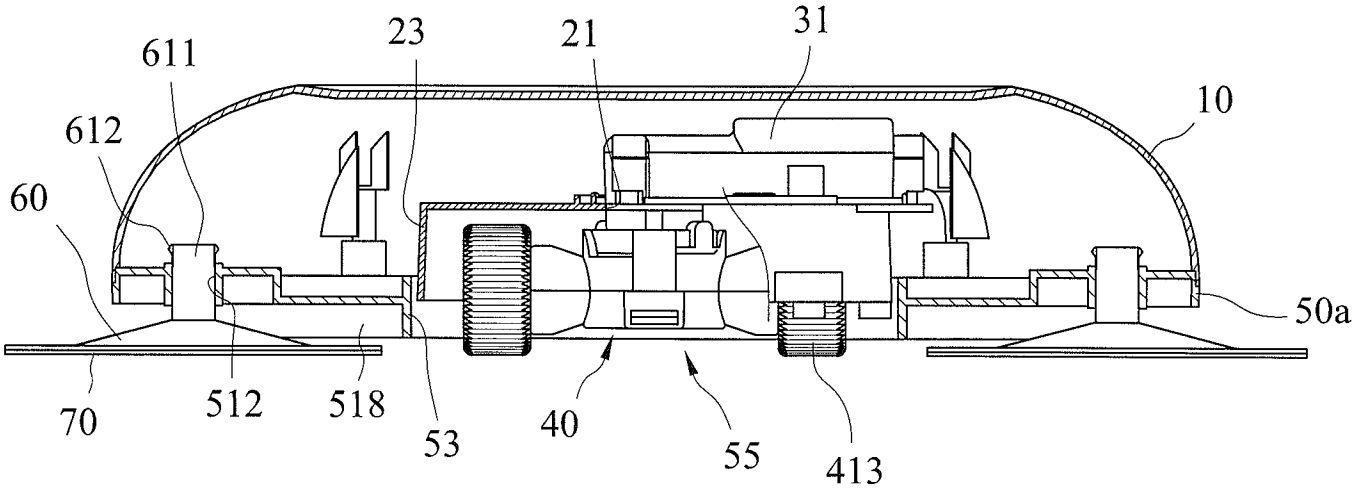
FIG. 11 is a cross-sectional view taken along line A-A in FIG. 10.
Figure 12:
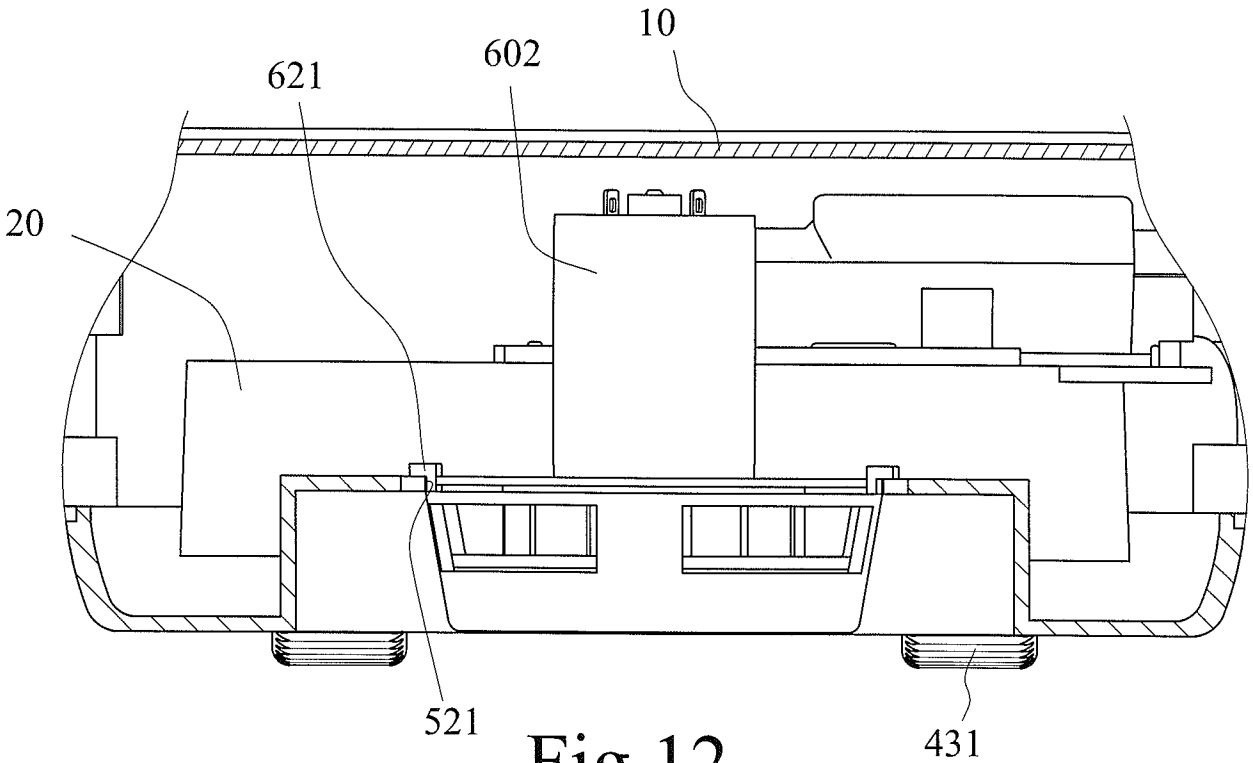
FIG. 12 is a partial, cross-sectional view taken along line B-B in FIG. 10.

When the automatic floor cleaning machine is embodied for cleaning, the dedusting papers 70 are adhered on the Velcro 62, and the automatic floor cleaning machine is placed on the floor 90 (FIG. 10). Then, the switch 11 is turned on to startup the vacuum cleaner 602, and to cause the random-turn driving unit 30 to operate on the floor 90. When the random-turn driving unit 30 is under operation, the drive wheel set 40 produces reaction torque to cause the automatic floor cleaning machine to turn in a direction opposite to that of the drive gear 42 and to move on the floor 90 randomly. The dedusting papers 70 stayed closely on the floor 90 will sweep the dust particles on the floor 90 and kick up a portion of the dust particles, then the kicked up dust particles can be sucked up by the vacuum cleaner 602 at the same time to further enhance the cleaning effect.

The automatic floor cleaning machine of the present invention has the following effects:

1. The floor cleaning plate 60 or 60*a* can be reliably and closely stayed on the floor for performing cleaning.

2. When the floor cleaning plate turns, the dedusting paper 70 adhered on the Velcro 62 can be used for sweeping the dust particles on the floor, and kicking up a portion of the dust particles. Then, the kicked up dust particles are sucked up by the vacuum cleaner 602 to be able to clean the floor thoroughly.

3. Because the fluff 83 extends from the bottom of the cleaning wool fabric 80 to the upper circumference of the cleaning wool fabric 80, not only that the adjoining surfaces (such as walls or corners) areas being cleaned by the cleaning wool fabric 80 can be enlarged, the problem of unevenness can also be avoided.

4. Because the dust sucking mouth 622 of the vacuum cleaner 602 disposed inside the base 50*a* is close to the floor, the vacuuming effect can be more outstanding.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An automatic floor cleaning machine comprising:

a base including a disc having an opening disposed in the disc, with a protruded edge formed around a circumference of the opening, with a power unit disposed on the disc;

an upper cover engaged on the base, with an accommodating space formed between the upper cover and the base;

a supporting seat engaged on the disc of the base and received in the accommodating space between the upper cover and the base, with the supporting seat including a top plate and a circumferential portion extending downwardly from a circumference of the top plate, with a motor base disposed on the top plate, with the circumferential portion mounted around the protruded edge of the disc, with a convoluted space formed by the circumferential portion and the opening of the disc;

a random-turn driving unit including a motor and a drive wheel set, with the motor fixed on the motor base of the supporting seat and electrically connected to the power unit, with the motor including an output shaft protruded from a bottom of the motor, with the drive wheel set disposed inside the convoluted space and including a lower wheel base and an upper wheel base, with the lower wheel base including a lower seat and a shaft rotatably disposed on the lower seat, with a driven gear disposed on the shaft, with a wheel disposed at each of two ends of the shaft, with a drive gear meshed with the driven gear and including a driving hole therein, with the upper wheel base including an upper seat coupled to the lower seat and receiving the drive gear, with a shaft hole formed in the upper seat and in alignment with the driving hole of the drive gear, with the output shaft extending through the shaft hole and engaged in the driving hole of the drive gear; and a floor cleaning plate engaged to a bottom of the base and including a hole in a center of the floor cleaning plate and in communication with the opening of the disc, with Velcro provided on a bottom of the floor cleaning plate and extending outwardly from two sides of the floor cleaning plate, with dedusting papers adhering to the Velcro.

2. The automatic floor cleaning machine according to claim 1, wherein the disc includes a plurality of engaging holes therein, with a plurality of protruded fasteners formed on the floor cleaning plate and around the hole of the floor cleaning plate, with a hook disposed at an upper end of each protruded fastener, with each protruded fastener of the floor cleaning plate extending through one of the engaging holes of the base, with the hooks engaging the protruded fasteners with the engaging holes.

3. The automatic floor cleaning machine according to claim 2, wherein a plurality of lugs extends outwardly from an outer surface of the circumferential portion of the supporting seat and each of the lugs having a connecting hole, with the disc including a plurality of coupling columns, with each of the coupling columns extending through one of the connecting holes and mounted around by a spring and secured by a screw.

4. The automatic floor cleaning machine according to claim 3, wherein two opposite coupling holes are disposed in the lower seat and located at two sides of the shaft, with a spring buckle disposed on each of two sides of the upper seat and engaged in one of the two coupling holes.

5. The automatic floor cleaning machine according to claim 3, wherein an annular flange is disposed on a bottom of the motor, with the output shaft located in the annular flange, with a plurality of fasteners and stopping pieces formed on the upper seat, with the stopping pieces pressed against the annular flange of the motor, with the fasteners stretched in an elastic fashion to press against the annular flange.

6. The automatic floor cleaning machine according to claim 3, wherein the floor cleaning plate has a shape roughly the same as that of the disc, with a switch disposed on the upper cover for controlling the startup of the automatic floor cleaning machine.

7. An automatic floor cleaning machine comprising:

a base including a disc having an opening disposed in the disc, with a protruded edge formed around a circumference of the opening, with a power unit disposed on the disc;

an upper cover engaged on the base, with an accommodating space formed between the upper cover and the base;

a supporting seat engaged on the disc of the base and received in the accommodating space between the upper cover and the base, with the supporting seat including a top plate and a circumferential portion extending downwardly from a circumference of the top plate, with a motor base disposed on the top plate, with the circumferential portion mounted around the protruded edge of the disc, with a convoluted space formed by the circumferential portion and the opening of the disc;

a random-turn driving unit including a motor and a drive wheel set, with the motor fixed on the motor base of the supporting seat and electrically connected to the power unit, with the motor including an output shaft protruded from a bottom of the motor, with the drive wheel set disposed inside the convoluted space and including a lower wheel base and an upper wheel base, with the lower wheel base including a lower seat and a shaft rotatably disposed on the lower seat, with a driven gear disposed on the shaft, with a wheel disposed at each of two ends of the shaft, with a drive gear meshed with the driven gear and including a driving hole therein, with the upper wheel base including an upper seat coupled to the lower seat and receiving the drive gear, with a shaft hole formed in the upper seat and in alignment with the driving hole of the drive gear, with the output shaft extending through the shaft hole and engaged in the driving hole of the drive gear; and a cleaning wool fabric engaged to a bottom of the base and including an upper opening in an upper end thereof for receiving the base, with the cleaning wool fabric further including a lower opening in a lower end thereof, with the wheels of the drive wheel set exposed outside from the lower opening, with fluff disposed on an outer periphery of the cleaning wool fabric.

8. The automatic floor cleaning machine according to claim 7, wherein an inner wall of the upper opening and an upper wall of the cleaning wool fabric are provided with elastic belts respectively, allowing the cleaning wool fabric to be sleeved around the bottom of the base securely.

9. The automatic floor cleaning machine according to claim 8, wherein a plurality of lugs extends outwardly from an outer surface of the circumferential portion of the supporting seat and each of the lugs having a connecting hole, with the disc including a plurality of coupling columns, with each of the coupling columns extending through one of the connecting holes and mounted around by a spring and secured by a screw, with an annular flange disposed on a bottom of the motor, with the output shaft located in the annular flange, with a plurality of fasteners and stopping pieces formed on a top edge of the upper seat, with the stopping pieces pressed against the annular flange of the motor, with the fasteners stretched in an elastic fashion to press against the annular flange.

10. An automatic floor cleaning machine comprising:

a base including a disc having an opening disposed in the disc, with a protruded edge formed around a circumference of the opening, with a power unit disposed on the disc, with at least one accommodating chamber disposed in a bottom of the disc, with a through-hole disposed in the accommodating chamber of the disc;

an upper cover engaged on the base, with an accommodating space formed between the upper cover and the base;

a supporting seat engaged on the disc of the base and received in the accommodating space between the upper cover and the base, with the supporting seat including a top plate and a circumferential portion extending downwardly from a circumference of the top plate, with a motor base disposed on the top plate, with the circumferential portion mounted around the protruded edge of the disc, with a convoluted space formed by the circumferential portion and the opening of the disc;

a random-turn driving unit including a motor and a drive wheel set, with the motor fixed on the motor base of the supporting seat and electrically connected to the power unit, with the motor including an output shaft protruded from a bottom of the motor, with the drive wheel set disposed inside the convoluted space and including a lower wheel base and an upper wheel base, with the lower wheel base including a lower seat and a shaft rotatably disposed on the lower seat, with a driven gear disposed on the shaft, with a wheel disposed at each of two ends of the shaft, with a drive gear disposed on the lower seat and meshed with the driven gear, with a driving hole disposed in the drive gear, with the upper wheel base including an upper seat coupled to the lower seat and receiving the drive gear, with a shaft hole formed in the upper seat and in alignment with the driving hole of the drive gear, with the output shaft extending through the shaft hole and engaged in the driving hole of the drive gear; and at least one floor cleaning plate received in the accommodating chamber of the disc of the base and including a protruded column on a top surface thereof, with the protruded column extending through the through-hole of the disc to engage the floor cleaning plate on the bottom of the disc, with Velcro provided on a bottom of the floor cleaning plate for adhering at least one dedusting paper.

11. The automatic floor cleaning machine according to claim 10 further comprising:

a vacuum cleaner including a dust sucking mouth disposed in a bottom thereof and two fastening lugs disposed on an outer circumference of the vacuum cleaner, with the disc including an accommodation opening spaced from the accommodating chamber and in communication with the opening of the disc, with the disc further including two fastening holes in two sides of the accommodation opening, with the vacuum cleaner installed inside the accommodation opening, with the fastening lugs fastened in the fastening holes of the disc to secure the vacuum cleaner in the base.

12. The automatic floor cleaning machine according to claim 11, wherein the disc includes two floor cleaning plate and two accommodating chamber disposed in two opposite corners of the bottom of the disc, with each of the accommodating chambers receiving one of the floor cleaning plates, with an elastic fastening lug disposed at a top end of the protruded column of each floor cleaning plate for preventing the protruded column from detaching from an associated through-hole, with the floor cleaning plates protruded outside the base.

13. The automatic floor cleaning machine according to claim 11, wherein a plurality of lugs extends outwardly from an outer surface of the circumferential portion of the supporting seat and each of the lugs having a connecting hole, with a plurality of indentations disposed in the protruded edge of the disc for receiving the lugs of the supporting seat respectively, with the disc including a plurality of coupling columns, with each of the coupling columns extending through one of the connecting holes and mounted around by a spring and secured by a screw.

* * * * *